US005428851A

United States Patent [19]

Shore et al.

[11] Patent Number: 5,428,851

[45] Date of Patent: Jul. 4, 1995

[54] TRANSFER TROLLEY

[76] Inventors: Andrew N. Shore, 22 High Street, Castleton, Whitby, North Yorkshire, NY21 2DA; Patrick A. Finlay, 49 Candlemas Lane, Beaconsfield, Buckinghamshire, HP9 1AE; Peter Cuthbert, 2 Bryony Court, Guisborough, Cleveland, TS14 8DX; Nigel R. Parker, 1 Railway Terrace, Brotton, Saltburn, Cleveland, TS12 2TH; Malcolm Roberts, 44 Hidcote Road, Oadby, Leicester, Leicestershire, LE2 5PE; Russel Miles, 46 Cambridge Street, Rugby, Warwickshire, CV21 3NG; David P. Kerr, 159 Watling Street Road, Preston, Lancashire, PR2 4AE, all of Great Britain

[21] Appl. No.: 721,494

[22] PCT Filed: Nov. 16, 1990

[86] PCT No.: PCT/GB90/01772

§ 371 Date: May 20, 1992

§ 102(e) Date: May 20, 1992

[87] PCT Pub. No.: WO91/07158

PCT Pub. Date: May 30, 1991

[30] Foreign Application Priority Data

Nov. 16, 1989 [GB] United Kingdom ..... 8925950

[51] Int. Cl.[6] ..... A61G 7/10; A61G 7/14

[52] U.S. Cl. ..... 5/86.1; 5/81.1; 5/424; 5/618

[58] Field of Search ..... 5/81.1, 86.1, 618, 424; 604/271

[56] References Cited

U.S. PATENT DOCUMENTS

| | | | |
|---|---|---|---|
| 1,857,031 | 5/1932 | Schaeffer | 5/86.1 |
| 3,178,732 | 4/1965 | Stibitz | 5/81.1 |
| 3,757,788 | 9/1973 | Renfroe | 5/81.1 |
| 4,084,275 | 4/1978 | Ilon | 5/81.1 |

*Primary Examiner*—Alexander Grosz

*Attorney, Agent, or Firm*—Nath, Amberly & Associates; Gary M. Nath

[57] ABSTRACT

A transfer trolley, to lift loads but particularly adapted to pick up a patient from a bet using a plurality of horizontally extending tines. Each tine consists of a tube having one end fixed in a position and a free open end. A sleeve surrounds the tube and is withdrawn into the interior of the tubes. The tines are then located next to a patient and a fluid under pressure is inserted into the sleeve, causing the sleeve to emerge from the end of the tube and to insinuate itself under the patient lifting the patient in the process. As the patient is lifted the trolley is moved to place the tube under the patient and to provide support while the patient is moved. The trolley can be adapted to move patients from beds or chairs.

12 Claims, 4 Drawing Sheets

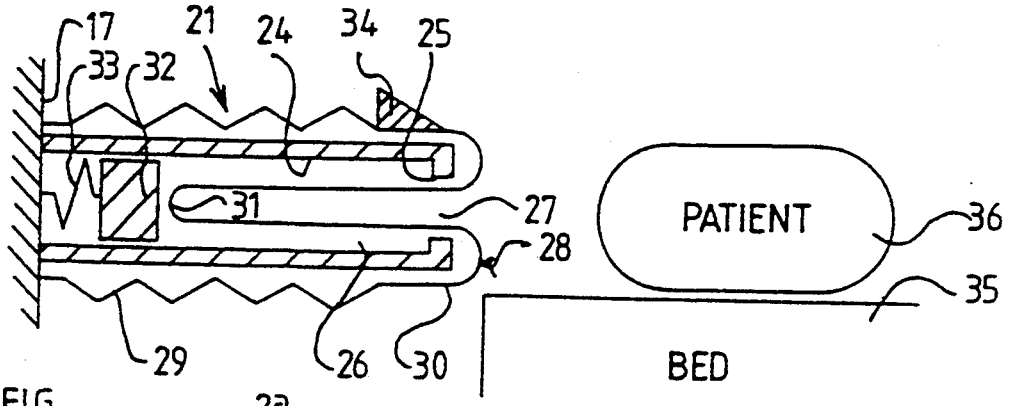
FIG 2a
FIG 2b
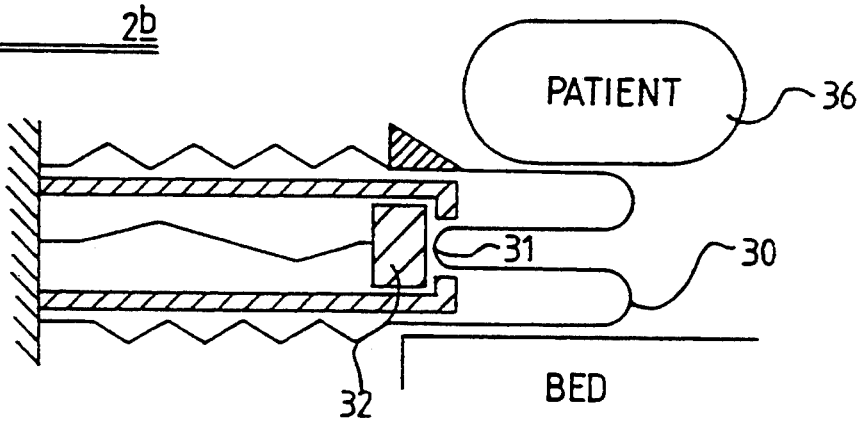
FIG 2c
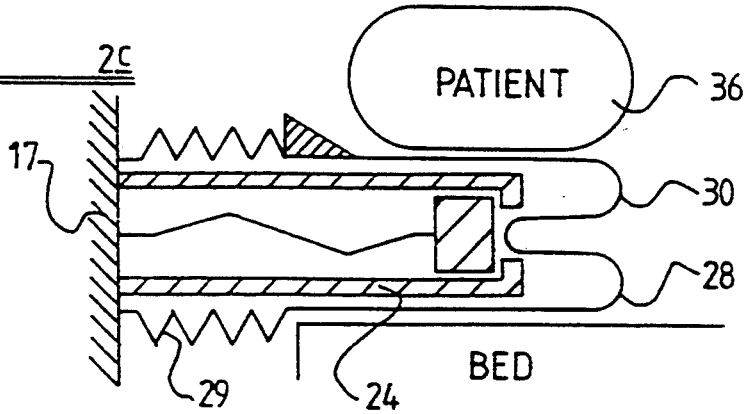

FIG 3
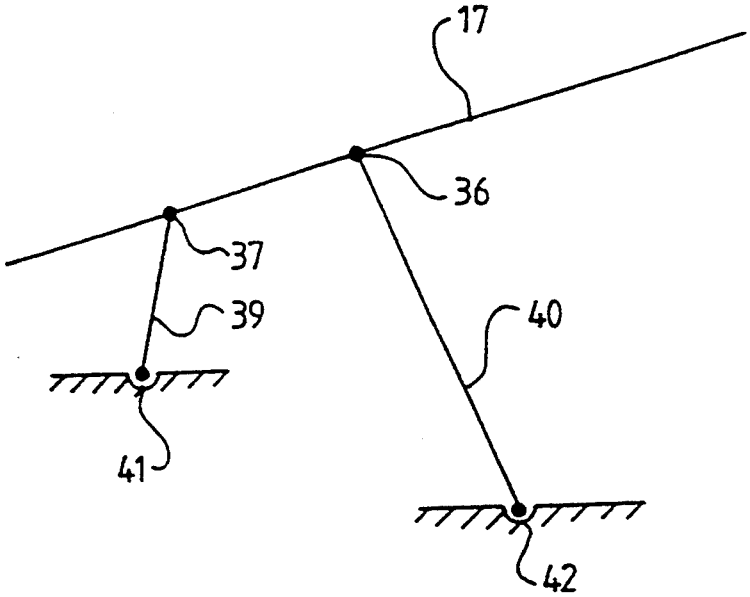
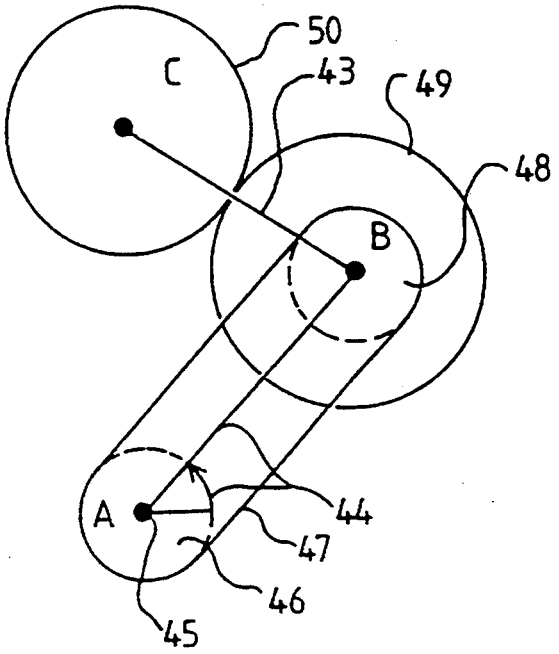
FIG 4

TRANSFER TROLLEY

THE PRESENT INVENTION relates to a transfer trolley and more particularly relates to a transfer trolley that can be used to lift a load and transfer it to a new location. One embodiment of the invention may comprise a patient transfer trolley adapted to transfer a patient from a bed to another location. However, a trolley in accordance with the invention may also be used to transfer and transport other loads, such as delicate items, comprising china, green ceramics, explosives, aerospace components or radio-active materials. A trolley in accordance with the invention may also be used to move motor vehicles, such as illegally parked vehicles.

At the present point in time there are over 380,000 people bed-ridden within the United Kingdom. It is envisaged that as the life expectancy of people increases, due to advances made in the field of medicine, the number of bed-ridden people may actually be increased.

Many nurses are injured attempting to lift bed-ridden patients out of their beds. When a nurse has to lift a patient, normally the nurse is in a very awkward posture, bending down, with the spine curved, and while in this posture the nurse has to lift the patient, who may be relatively heavy. It is not wise to apply a load to the spine while it is curved and thus it is not surprising that many nurses suffer from back injuries as a result of attempting to lift patients.

Various attempts have been made to provide a patient transfer trolley adapted to pick up a patient from a bed and transport the patient. The present invention seeks to provide an improved trolley of this type.

According to one aspect of this invention there is provided a trolley comprising a movable wheeled structure incorporating a plurality of elements adapted to engage and lift a load lying on a support, each element comprising a sleeve formed of a resilient material mounted at one end on a support, and having the other end initially re-entrant within the sleeve, means being provided to cause the sleeve to extend, insinuating itself under the load in order to lift the load. The load may be a patient lying on a bed, wherein rigid support means are provided adapted to be located under the load when the said sleeve has insinuated itself under the load.

Conveniently the support means are located within the sleeve. Alternatively the rigid elements may be located between the sleeves.

Advantageously the support means comprise rigid elements, and the trolley is provided with means to move the trolley, and the rigid elements, in such a direction that the rigid elements are located under the load at an appropriate time.

In one embodiment the support means comprise chains which are flexible in one orientation, and stiff when rotated by 90°.

Preferably the means to cause the sleeve to become extended comprise means adapted to supply a pressure fluid to the interior of the sleeve, such as a hydraulic fluid or a pneumatic fluid.

Conveniently each sleeve has an initial portion of bellows of concertina form and a terminal portion with a substantially smooth exterior.

Preferably said trolley comprises a wheeled chassis carrying said elements, each wheel being associated with sensor means adapted to sense when the vertical force applied to the wheel by the trolley is, or is approaching, zero, means being provided to respond to such a situation existing.

Preferably means are provided to move said elements relative to the trolley, means being provided to stop or reverse such movement of the load when a situation is sensed in which the vertical force applied, by the trolley, to one or more of the wheels is, or is approaching, zero.

Conveniently the said elements are selectively operable so that, on any particular occasion, one or more elements may not be operated, thus not contacting the load.

Preferably the elements can be selectively hinged to an inoperative position.

Advantageously said trolley comprises a wheeled structure supporting at least three beams, each beam carrying a plurality of said elements which project laterally therefrom at least two beams being hinged relative to one another, about virtual hinge points.

Preferably the said beams comprise robotically controlled arms to provide the virtual hinge.

Conveniently one of said beams is telescopic, so that the length thereof can be selectively adjusted.

Preferably the trolley incorporates imaging means adapted to obtain an image of the load, and processing means adapted to process the image and to derive a programmed routine for lifting the load.

Preferably the trolley is provided with memory means including means to store data relating to various load. Thus the memory may store data such as the weight and centre of gravity of various patients, together with information relating to the location of wounds or burns on the patient.

Preferably the trolley is adapted to lift a patient from a support such as a bed on which the patient is lying and adapted to lift a patient from a support such as a chair on which the patient is sitting.

According to another aspect of this invention there is provided a trolley, said trolley comprising a wheeled chassis carrying support means on which a load may be supported, each wheel being associated with sensor means adapted to sense when the vertical force applied to the wheel by the trolley is, or is approaching, zero, means being provided to respond to such a situation existing.

According to yet another aspect of this invention there is provided a trolley for lifting a load from a support, said trolley comprising a support having a plurality of projecting tines adapted to engage and lift the load, the tines being selectively operable so that, on any particular occasion, one or more tines may not be operated, thus not contacting the load.

According to a further aspect of this invention there is provided a trolley for lifting a load from a support, said trolley comprising a wheeled structure supporting at least three beams, each beam carrying a plurality of laterally projecting tines adapted to engage and support a load, the beams being hinged relative to one another, about virtual hinge points.

According to yet a further aspect of this invention there is provided a trolley for lifting a load from a bed, the trolley incorporating a support structure and means adapted to engage the load, the trolley further incorporating imaging means adapted to obtain an image of the load, and processing means adapted to process the image and to derive a programmed routine for lifting the load.

In order that the invention may be more readily understood, and so that further features thereof may be appreciated, the invention will now be described, by way of example, with reference to the accompanying drawings in which:

FIG. 1 is a partially exploded perspective view of a patient transfer trolley in accordance with the invention, FIG. 2 is a series of diagrammatic views illustrating the structure of each tine of the apparatus shown in FIG. 1 and illustrating how a patient is acquired from a bed.

FIG. 2*a* is a cross-sectional view of the transfer trolley with the sleeve in the retracted position adjacent to the patient to be lifted.

FIG. 2*b* is a cross-sectional view of the trolley after the sleeve has insinuated under the patient when pressure is introduced into the sleeve.

FIG. 2*c* is a cross-sectional view of the patient over the support tube after the trolley has been moved closer to the patient while it is being lifted by the sleeve.

FIG. 2*d* illustrates a final position in which the patient is supported fully on top of the tube.

FIG. 2*e* illustrates the beginning of the process to return the patient to the bed as the sleeve is withdrawn.

FIG. 2*f* illustrates the completion of the process with the trolley adjacent to bed after lowering the patient.

FIG. 3 is a diagrammatic view of a virtual hinge arrangement, and

FIG. 4 is a diagrammatic view of another virtual hinge arrangement.

Figure 1:
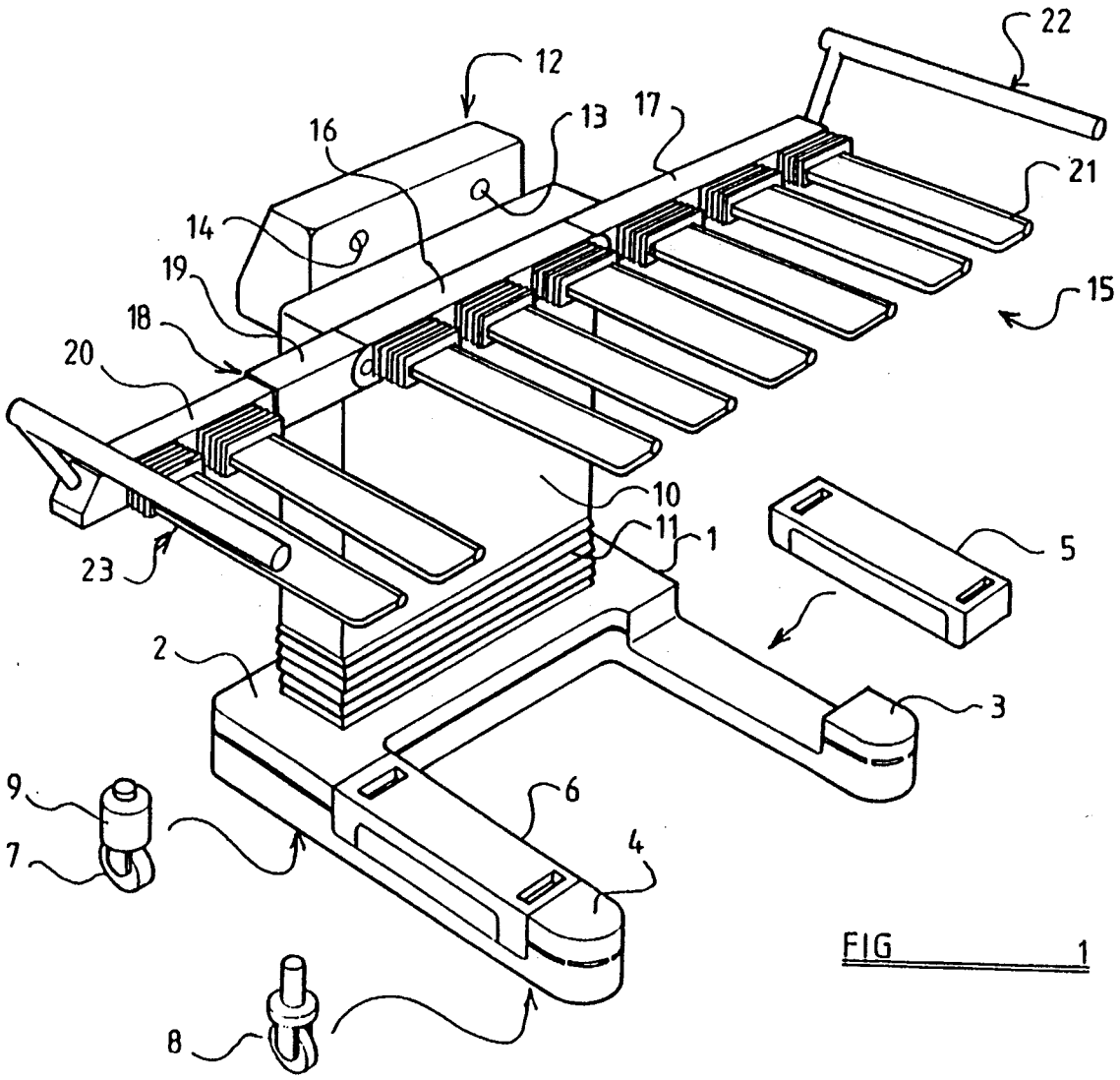

Referring to the drawings, a patient transfer trolley in accordance with the invention comprises a substantially horizontal "C"-shaped frame 1 which comprises the basic chassis for the device. The chassis thus consists of a main axially extending portion 2, having two laterally extending arms 3, 4. A recess is provided in the upper part of each of the arms 3,4, the recess receiving a rechargable battery pack 5,6. The batteries may be of any convenient form, but are provided at this location to assist in providing stability for the arrangement.

The chassis is provided with four wheels. Two of the wheels 7,8 are illustrated, and are mounted in position at one end of the main portion 2 of the chassis and on the arm 4. Two corresponding wheels (not shown) are provided to be mounted at the other end of the main portion 2 of the chassis and on the arm 3.

The wheel 7 located at one end of the main chassis portion 2, is provided with a motor arrangement 9 which is adapted to turn the wheel 7 about a vertical axis, so that the wheel may have a predetermined orientation, and which is also adapted to drive the wheel rotationally. The wheel provided on the arm 3 is provided with a similar motor arrangement, so that the two powered and steered wheels are diagonally opposed. The wheel 8 and the wheel provided on the main chassis portion 2 adjacent the arm 3 may be castor wheels which are free to rotate about a vertical axis and which are free to roll along the floor which supports the trolley, or may be multi-wheels as sold under the Registered Trade Mark OMNIROLL, which are wheels that enable the chassis to roll in any direction, but with a preferred rolling axis which is coincident with the axis of the trolley.

It is to be understood that the means (to be described) to lift the load are partly cantilevered beyond the area boarded by the chassis 2. Thus, in certain circumstances, if the centre of gravity of the load is located on the cantilevered part of the load lifting means, the trolley could tip over. In the described embodiment of the invention each of the four wheels provided on the chassis is associated with a load sensor adapted to sense the vertical load applied to the wheel by the trolley. It will be appreciated that if the trolley is reaching a condition at which the trolley will topple over, the load applied to one or more wheels will reduce to zero. Thus each wheel is associated with a strain gauge or a load cell provided within the chassis 1, and the output of each strain gauge or load cell is fed to a controlling microprocessor or computer which is incorporated in the device. The computer will be programmed so that if the signals derived from the strain gauges or load cells indicate that the trolley is about to topple over, the movement then being executed by any part of the trolley will be modified. The movement then being executed may be terminated or may be reversed, or may be modified in some other way.

The main portion 2 of the chassis 1 has mounted thereon a vertically extending support tower 10. The overall height of the tower 10 may be adjusted, by means of an appropriate mechanism contained within the tower and thus the bottom part of the support tower is defined by flexible extensible bellows 11. The mechanism to adjust the height of the tower may be hydraulic, pneumatic or electro-mechanical.

Mounted at the top of the support tower 10, on the side of the tower 10 that is opposite the arms 3 and 4 of the chassis 2, is a control housing 12. Part of the control housing 12 extends above the top of the tower 10 and contained within the control housing 12 are one or more imaging cameras 13,14, the purpose of which will be described hereinafter. The imaging cameras 13,14 have a field of view which extends into an area located above the chassis 2.

Mounted on the other side of the support tower 10, at the top, is a patient support mechanism 15. The mechanism 15 is thus located above the arms 3,4 of the chassis 2.

The patient support mechanism 15 consists of a first horizontal beam 16 secured to the top of the support tower 10, a second beam 17 which is hingedly mounted relative to one end of the first beam and which in one position extends axially therefrom, and a third beam 18 which is hingedly mounted relative to the other end of the first beam 16 and which, in one position, extends axially therefrom. The beam 18 consists of an initial outer sleeve 19 and a telescopically extending inner beam portion 20 which is telescopically received within the outer sleeve 19. Mounted on each of the beam 16, the beam 17 and the telescopically extending beam portion 20 are a plurality of horizontally extending extensible patient support tines 21 which will be described hereinafter in greater detail.

As can be seen from FIG. 1, when the beams 16, 17 and 18 are all in the horizontal condition, the tines 21 all extend horizontally and effectively co-operate to form a bed or couch. The bed or couch is dimensioned to receive a typical patient.

Mounted at the free end of the beam 17 and also mounted at the free end of the beam portion 20 are force-sensitive driving and steering bars 22,23. Each driving and steering bar is of elongate form, extending parallel with one of the tines 21, and connected to the respective beam by means of a support strut. The bar is provided with force-sensitive means at strategic locations, such as pressure sensitive transducers, the outputs of the transducers being fed to the controlling microprocessor or computer such that when pressure is sensed by the transducers the computer causes the wheels which are provided with motors (such as the wheel 7) to rotate in an appropriate direction at an appropriate speed. The direction and speed of rotation of the wheels will be determined by the force applied to the driving and steering bar 22 or 23 by a nurse pushing or pulling the trolley. Further areas of the bars 22,23 may cause the operation of the mechanism that adjusts the height of the support tower 10. In any event it will be understood that the bars 22,23 may be utilised to exert a significant degree of control over the movement of the trolley as a whole.

Movement of the trolley can also be controlled by means of a control panel on the front face of the controle housing 12 or movement of the trolley may be controlled by a voice responsive system. Otherwise, the device may be totally pre-programmed and in such a case the chassis 1 may be provided with appropriate sensors to enable the chassis to follow a guide wire embedded in the floor or a guide line painted or otherwise formed on the floor. Alternatively the chassis may have an autonomous navigation system. Such a system would include a set of optical sensors, such as sensors operating in the infra-red spectrum, which operate to ensure that the trolley does not collide with any fixed object, such as a wall, and does not collide with a movable object, such as another trolley or a person. The system is controlled by a computer which has stored within it a "map" of the area where the trolley is to operate, and means to calculate the position of the trolley from measurements relating to the orientation of the driven wheels relative to the trolley and the number of revolutions of each driven wheel. To prevent cumulative error arising various "markers" may be provided within the area of operation of the trolley, adapted to be read by the trolley to give an accurate position of the trolley to the computer. Such "markers" may be markings on the floor or on the wall adapted to be read and identified by means provided for that purpose on the trolley.

Referring now to FIG. 2 the structure of one of the tines 21 can be seen in FIG. 2A. The tine consists of a hollow tube 24, of circular or elliptical section, which is shown in cross-section in FIG. 2. The tube 24 has one end mounted on the beam 17. At the other end the tube terminates with a radially inwardly directed lip 25. The tube 24 has a hollow interim 26. The lip 55 defines a central aperture 27 which communicates with the interior 26.

A resilient sleeve or sheath 28 is provided which surrounds the tube 24. The sheath incorporates an initial region 29, having an open end sealed to the beam 17 which is of bellows or "concertina" form. The initial region 29 merges with a terminal portion 30 which has a smoother exterior, but is still provided a certain coefficient of friction. The free end 31 of the terminal portion 30 is closed. The free end 31 is connected to a plunger 32, to which is connected a draw wire 33, the wire 33 and the plunger 32 being located in the hollow interior 26 of the tube 24. The plunger 32 is optional and may be omitted. A triangular wedge 34 may be provided on the upper part of the sleeve 28 at the termination of the bellows portion 29, where it merges with the terminal portion 30.

It will be appreciated that it is desired, when utilising the trolley, to be able to transfer a patient from a position resting on a bed to a position supported by the tines 21, and vice-versa. To achieve this end initially the patient transfer trolley is located with the tines in the substantially horizontal position at a level just above the level of the upper surface of a bed 35 on which a patient 36 is resting. The sleeves 28 provided on the fingers 24 are fully retracted. That is to say the plungers 32 are retracted fully to the left as shown in FIG. 2 so that the terminal portion 30 of each sleeve is drawn back through the opening 27 into the interior 26 of the tube 24. The bellows or concertina portion 29 is therefore fully extended.

Figure 2D:
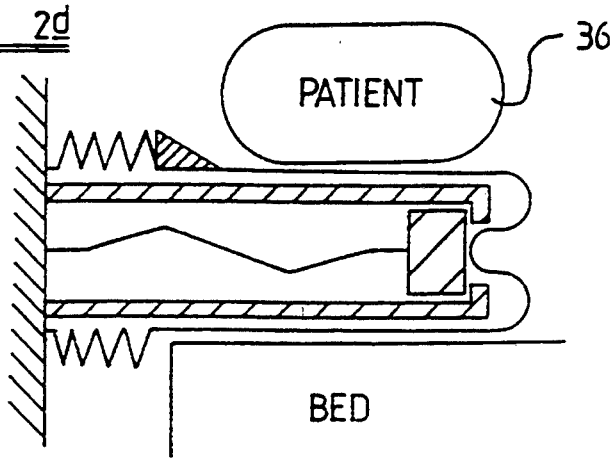

Initially low pressure hydraulic fluid or a pneumatic fluid is supplied to the inside of the sleeve 28, thus forcing the part of the terminal portion 30 of the sleeve 28 that is inside the tube 24 to emerge through the opening 27. The source of the pressurised fluid may be within the tower 12. Preferably the pressurised fluid is a pneumatic fluid at a pressure of the order of 30 to 45 $kN/m^2$. This part of the sleeve insinuates itself under the patient 36, lifting the patient 36 upwardly. During this process the plunger 32 moves to the end of the interior 26 of the tube 24 and the draw wire 33 is also extended as can be seen in FIG. 2B. Whilst this step is performed the chassis 1 is moved slightly towards the patient to assist in insinuating the terminal portion 30 of the sleeve 28 under the patient. Subsequently, the trolley is moved further towards the patient whilst simultaneously the bellows portion 29 of the sleeve 28 contracts. Since the patient is gripped by the outer surface of the end portion 30 of the sleeve 28, the patient is guided, by that end portion of the sleeve to a position in which the patient 36 is located at least partially above the tube 24 as shown in FIG. 2C. FIG. 2D illustrates a final position in which the patient 36 is supported fully on top of the tube 24, and the patient can then be removed from the bed and transported by means of the trolley.

It is to be noted that the part of the sleeve 28 that touches the patient does not really move relative to the patient. Thus there is no sliding movement between the sleeve 28 and the patient. Instead the sleeve unravels itself from its retracted position to its extended position, gently wrapping itself against the patient. Thus the sleeve 28 does not exert any frictional effects on the patient. This can be of importance where the patient has burns, sores or other wounds.

Figure 2E:
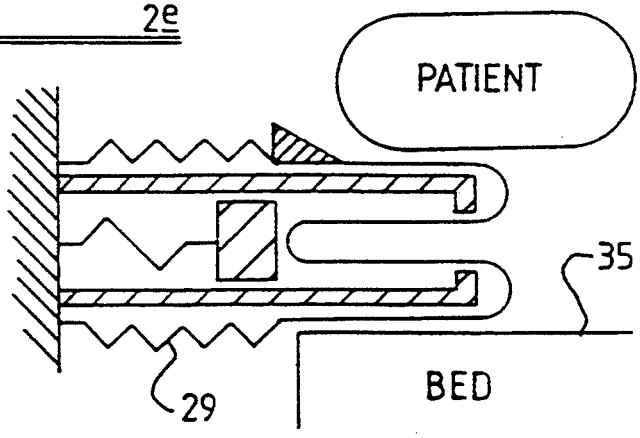
Figure 2F:
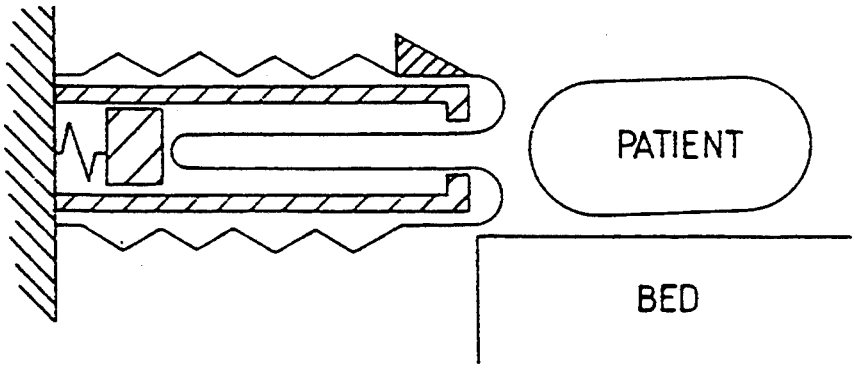

As shown in FIG. 2E, when the patient is to be returned to the bed, the trolley is again located with the patient supported above the bed 35. The plunger 32 is then drawn towards the left, by the draw wire 33, and the terminal portion 30 of the sleeve 28 is drawn into the hollow interior 26 of the tube 24, whilst the bellows portion 29 expands, and during this procedure the trolley may be moved towards the left, thus lowering a patient on to the bed, as shown in FIG. 2F.

It is to be appreciated that the tines as illustrated and described operate on the basic concept of inserting an inflatable sleeve under a patient by initially having a terminal portion of the sleeve drawn back into the interior of the sleeve in a re-entrant manner, so that a part of the sleeve which is intermediate the ends of the sleeve may first be brought into contact with the patient, and then inflating the sleeve. Since this procedure is utilised, as the sleeve is inflated, the part of the sleeve that initially contacts the patient remains in contact with the patient at the same point on the patient, and more and more of the sleeve is gradually insinuated under the patient in order to support and lift the patient.

There is no sliding movement between the sleeve and the patient. Instead the sleeve unravels from its initial position, and wraps itself against the patient. Once the inflatable part of the sleeve has been insinuated under the patient, then a procedural step is followed in order to provide a rigid support beneath the patient. In the described arrangement this step comprises the simultaneous movement towards the right as illustrated in FIG. 2B, with the contraction of the bellows portion 2° of the sleeve, to locate the finger 24 under the patient. However, alternative expedients may be adopted.

Thus, for example, once a patient has been supported on a plurality of inflated elements, rigid elements may be inserted between the inflated elements. Alternatively, instead of sliding a rigid finger 24 into position beneath the patient within the inflated sleeve, a flexible chain could be provided which moves with the sleeve under the patient, the chain being of the type that has rigid side plates interconnected by transverse pivot pins. Thus the chain resembles a conventional bicycle chain. The chain is initially in a position with the pivot pins extending horizontally. Thus as the chain, within the sleeve, moves under the patient it can flex. When the sleeve, and the chain, are fully extended, the chain is rotated by 90° so as to become rigid, with regard to any force applied to the chain in the vertical direction. The chain can thus support the load applied to the tine. One advantage of this is that the chain would be contained within the sleeve and would thus not impart any friction on the patient.

It will be appreciated that all the tines 21 of the trolley illustrated in FIG. 1 may be operated in synchronism in order to lift a patient. However, this may not be desirable, especially if the patient has severe wounds or burns on specific areas of the body, and thus it is preferred that the tines be selectively operable. Thus, in response to appropriate control signals from the control panel, or in response to other appropriate control signals, only selected tines will operate during any particular lifting cycle. Means may be provided to enable the tines which are not utilised to be hinged to a totally retracted position.

The sleeves 28 are preferably formed from fabric coated with rubber, or some other flexible material that is impervious to the pressure fluid being used. The fabric may be of any form, such as a relatively open weave scrim, or may be an unwoven batt. It is thought that fabric having fibres which extend predominantly in one direction may offer benefits of stable deployment. The sleeve 28 should present a comfortable outer surface, and may thus have a velvet-like or furry exterior. The sleeves 28 may be disposable, or may be covered with separate disposable covers, for the sake of sterility, especially if the described device is to be used to lift patients with open wounds.

As has been mentioned, the beams 17 and 18 are hingedly mounted. It is envisaged that the beam 17 may hinge upwardly whereas the beam 18 may hinge downwardly. Thus, the trolley may be converted from having a configuration equivalent to a couch or bed, to a configuration equivalent to a chair. Whilst a direct mechanical hinge has been illustrated in FIG. 1 it is to be appreciated that such a direct mechanical hinge may not be ideal, especially if the movement between a couch or bed and a chair is to be effected whilst a patient is on the trolley. The reason for this is that if a patient is lying on the trolley when it is in the bed or couch configuration as illustrated in FIG. 1, the actual hinge, in the patient, between the upper legs and the trunk of the patient is actually defined by the ball-and-socket joint between the femur and the pelvis. This ball and socket joint will be located at a level which is above the level defined by the beams 16 and 17. Thus the two parts of the patient will hinge about a point which is not coincident with either of the beams 16 and 17. Consequently, in the described embodiment, the patient will hinge about an axis which is not coincident with the hinging axis between the two beams 16 and 17, which may lead to some of the tines sliding across the skin of the patient. In order to avoid this problem it is preferred to use an arrangement in which the beams are connected together by means of a virtual hinge. This can be accomplished by mounting the beam 17 on a robotically controlled arm, or by providing some other form of virtual hinge, and by taking similar action with reference to the beam 18. The software in the computer which controls the robotically controlled arm, ensures that the arm only executes a predetermined range of movements about a defined virtual hinge axis. The software may enable the position of the virtual hinge axis to be adjusted.

FIG. 3 illustrates one mechanical arrangement for a virtual hinge which could be used in connection with the beam 17. The beam 17 is connected, at spaced apart pivot points 37,38, to two pivotting members 39,40 respectively. Member 39 is pivotted at a fixed point 41 and the member 40 is pivotted at a fixed point 42. It can be seen that such an arrangement will cause the beam 17 to pivot about a virtual pivot point which is defined by the inter-section of the axes of the elements 39 and 40. Thus, if the left-hand end of the beam 17 is moved downwardly, the elements 39 and 40 will both pivot about their lower pivot points 41,42 in a clock-wise direction, thus causing the right-hand end of the beam 17 to move upwardly. This motion would be reversed if the right-hand end of the beam 17 is moved downwardly. The position of the virtual hinge axis may be adjusted if either of the elements 39,40 are of adjustable length, or if the position of the pivot points 41,42 can be adjusted.

A similar effect can be achieved by different means, as illustrated in FIG. 4. A line 43 interconnecting two points B and C represents a beam that is mounted on a virtual hinge. The beam 43 is pivotted at point B to a support beam 44. The support beam 44 may be driven rotationally about a pivotal mounting 45. Co-axial with the pivotal mounting 45 is a drive wheel 46 which drives a belt or chain 47 which engages a further drive wheel 48 which is coincident with the pivot point B. The drive wheel 48 is formed integrally with a larger cog-wheel 49 which engages a cog-wheel 50 which is pivotally mounted to the beam 43 at the point C.

The arrangement is such that the element represented by the line 49 can move when the element 44 is pivotted about the pivot point 45, without the angular inclination between the beam 43 and the element 44 changing. However, if the wheel 46 is rotated, the wheel 48 will rotate thus rotating the wheel 49 and the wheel 50 causing the angular orientation between the beam 43 and the element 44 to be altered. Thus again the beam 43 is effectively mounted on a virtual hinge.

Other forms of virtual hinge may be utilised.

It is also preferred that the entire bed or couch may be tilted from the horizontal position indicated to an inclined position, bringing the feet of the patient resting on the tines to the floor, so that the patient may effectively be "stood-up" by the arrangement. The beams 16 and 17 may be selectively positioned in any desired inclination relative to the beam 18, and the beam 18 may have any desired inclination relative to the horizontal, so that virtually any desired condition can be achieved.

Reference was made to imaging cameras 13 and 14, present on the control panel 12. These imaging cameras are provided to view a patient lying on a bed, to ascertain the precise position at which the trolley should be located to facilitate lifting the patient. Also the image may be used to ascertain the order in which the tines should be operated.

The controlling computer may have a memory in which critical information relating to each patient to be transported by the machine may be stored in the form of a "template". The information may comprise data relating to weight, and centre of gravity of the body, and any specific limitations on handling the patient, with particular reference to any wounds that are not to be contacted by the tines. If such an expedient is adopted means will be provided to enable the trolley to identify the particular patient to be lifted, either by having stored in its memory an indication of the location of the bed of the patient, or by reading off a marking present on the bed of the patient, or preferably on the actual patient, such as a marking on a bracelet, which serves to identify the patient.

It is to be noted that the described trolley may be used for purposes other than merely transporting patients. Since the trolley is capable of manipulating a patient, the trolley may be utilised to carry out certain physiotherapy procedures. Thus the trolley may place a particular patient in a preliminary position necessary for certain physiotherapy exercises, or may actually manipulate the patient so that certain physiotherapy is carried out, possibly with the patient exercising muscular power in an attempt to prevent the movements being imparted to the patient by the machine.

It is to be noted that the telescopic arm 20 facilitates the use of the apparatus with patients of different heights, and may also be useful when executing the movement described above in which the patient is stood-up on the floor.

It is to be appreciated that the trolley may be moved to a "wheel-chair" configuration for storage purposes, the space then occupied by the trolley being effectively determined by the floor area of the chassis.

While the invention has been described with reference to the trolley lifting a patient from a bed, the trolley may equally be used to lift a patient from a chair, or a toilet, when the patient is in a sitting position, and to return or deliver the patient to such a location.

The described embodiment incorporates a self-propelling mechanism, but a trolley in accordance with the invention need not have this facility. The trolley could be a simple trolley that is pushed from place to place, for example by a nurse.

As a patient is being transported on the trolley it is possible to determine the weight of the patient from signals from the load sensors associated with the wheels of the trolley.

Also, while the invention has been described principally with regard to examples specifically intended to lift patients, it is to be understood that trollies in accordance with this invention may also be used to lift loads of any type, such as delicate loads comprising china, green ceramics, explosives, aerospace components or radio-active materials. Other embodiments of the invention may be devised for lifting items such as motor vehicles, for example, illegally parked motor vehicles.

We claim:

1. A transfer trolley comprising:

a movable structure having a plurality of wheels;

a beam attached to said movable structure;

a plurality of tines adapted to engage and lift a load, said tines comprising a sleeve formed of a resilient material and having a first and second end, said first sleeve end mounted on said beam and said second sleeve end initially re-entrant within the sleeve;

a rigid support tube within said sleeve, said support tube having a first and second end, said first support tube end mounted on said beam;

extending means to cause the sleeve to extend, insinuating itself under the load in order to lift the load; and a locomotion means to move the trolley and attached support tube under the load after lifting by said sleeve extension, said extending means comprising a pressure fluid supply means to supply pressure to the interior of the sleeve.

2. A transfer trolley according to claim 1 wherein:

said sleeve has an initial portion of bellows or concertina form and a terminal portion with a substantially smooth exterior.

3. A transfer trolley, according to claim 1 wherein;

said trolley further comprise a sensor means for sensing when the vertical force applied to said wheel by the trolley is, or is approaching, zero.

4. A transfer trolley according to claim 3 further comprising:

a movement means connected to said tines to move said tines relative to said trolley, said movement means being provided to stop or reverse movement of said load when said sensor means senses the vertical force applied to one or more of said wheels is, or is approaching, zero.

5. A transfer trolley according to claim 1 wherein:

said tines are selectively operable so that one or more tines may not be operated, thus not contacting said load.

6. A transfer trolley according to claim 1 wherein:

said trolley beam comprises at least three beam segments, each beam segment carrying a plurality of said tines projecting laterally therefrom, at least two beam segments being hinged relative to one another, about virtual hinge points.

7. A transfer trolley according to claim 6 wherein;

said beam segments comprise robotically controlled arms to provide the virtual hinge.

8. A transfer trolley according to claim 7 wherein:

said tines can be selectively hinged to an inoperative position.

9. A transfer trolley according to claim 7 wherein:

one or more of said beam segments is telescopic, so that the length thereof can be selectively adjusted.

10. A transfer trolley according to claim 1 wherein said trolley further comprises imaging means to obtain an image of the load, processing means for processing said image and computing means to derive a programmed routine for lifting the load.

11. A transfer trolley according to claim 10 wherein:

said trolley further comprises a memory means to store data relating to various loads.

12. A transfer trolley according to claim 1 wherein:

said trolley is adapted to lift a patient from a support such as a bed on which the patient is lying and adapted to lift a patient from a support such as a chair on which the patient is sitting.

* * * * *